United States Patent [19]

Lamont

[11] Patent Number: 4,683,784

[45] Date of Patent: Aug. 4, 1987

[54] HAMMER

[75] Inventor: Patrick A. Lamont, Transvaal, South Africa

[73] Assignee: C.C.L. South Africa (Proprietary) Limited, South Africa

[21] Appl. No.: 828,179

[22] Filed: Feb. 11, 1986

[30] Foreign Application Priority Data

Feb. 22, 1985 [ZA] South Africa ..... 85/1343

[51] Int. Cl.[4] ..... B25G 1/00

[52] U.S. Cl. ..... 81/22; 81/20; 16/116 R

[58] Field of Search ..... 81/22, 20; 16/116 R; 267/158, 160; 43/18.1; 74/551.2

[56] References Cited

U.S. PATENT DOCUMENTS 2,104,494 1/1938 O'Brien ..... 43/18.1

3,882,569 5/1975 Vanderveer ..... 16/110 A X 4,096,895 6/1978 Fernitz ..... 81/20

FOREIGN PATENT DOCUMENTS 8200265 2/1982 World Int. Prop. O. ..... 81/22

*Primary Examiner*—E. R. Kazenske

*Assistant Examiner*—Scott A. Smith

*Attorney, Agent, or Firm*—Wood, Herron & Evans

[57] ABSTRACT

This invention relates to a hammer which includes a handle which is made from a flexible material and carries, in combination, rod and strip shaped reinforcing elements which extend over the effective length of the handle. The or each strip shaped reinforcing element is normal to the strike direction of the hammer head. The reinforcing elements are held apart by spacers located along the length of the element.

1 Claim, 5 Drawing Figures

HAMMER

FIELD OF THE INVENTION

This invention relates to hammers, axes, picks or the like and more paricularly to handles for use with long handled heavy hammers.

BACKGROUND OF THE INVENTION

The applicant is aware of handles used with hammers, which are made of an elastomeric material reinforced with steel rods or steel bars. In one form of handle the reinforcing consists of six spaced rods which are circular in cross-section. A problem with this type of handle is that it does not effectively resist torsional and bending forces during use. This leads to the breakdown and failure of the bond between the elastomeric material and the reinforcing rods in the handle resulting in the head of the hammer wandering from the striking plane, and rendering the hammer useless. With another form of handle the reinforcing takes the form of two parallel strips of metal which are located in the handle material with their plane direction lying in the strike direction of the hammer head. A problem with this handle is that the reinforcing strips become fatigued to failure by the bending moments imposed on them adjacent to the hammer head in their plane direction after prolonged use.

OBJECT OF THIS INVENTION

It is the object of this invention to provide a hammer and a hammer handle with which the above problems are minimised.

SUMMARY OF THE INVENTION

A hammer according to the invention includes a hammer head and a handle which is made from a flexible material and carries, in combination, rod and strip shaped reinforcing elements which extend over the effective length of the handle and in which the general plane of the or each strip shaped reinforcing element is normal to the strike direction of the hammer head.

Conveniently, the reinforcing elements in the handle are separated from each other in the handle material by spacers which are spaced over the length of the handle.

In one form of the invention the reinforcing elements consist of one strip shaped element and at least one rod shaped element which is located adjacent each of the flat sides of the strip shaped element. Preferably two spaced rod shaped reinforcing elements are located adjacent each of the flat sides of the strip shaped element. By combining the or each rod shaped element with the or each strip shaped element surrounded by elastomeric material as a composite handle the torsional and fatique failure problems mentioned above are minimised. The reason for this is that the or each flat strip shaped element effectively resists torsional forces.

Further, according to the invention the hammer head includes a bore through which the handle is located in the head with the head including a recess which surrounds the end of its bore on the opposite side of the head to that from which the handle projects with the handle including an anchor plate which is engaged with the reinforcing elements in the head recess to prevent withdrawal of the handle from the head.

Preferably the handle material is a suitable elastomer, polymer epoxy or other resilient substance which bonds with the reinforcing elements and hammer head to form a composite unit which is able to withstand torsional and bending forces during use. The handle material is conveniently resilient to the extent that it is able to absorb and dissipate shocks, provide a good grip and feel comfortable during use.

A hammer according to the invention includes a head and a handle which is made from a suitable elastomeric material and is reinforced over its effective length by reinforcing which includes at least one strip shaped element with the general plane of the element being normal to the strike direction of the hammer head.

BRIEF DESCRIPTION OF THE DRAWINGS

The invention is now described by way of example only with reference to the drawings in which include.

DETAILED DESCRIPTION OF THE PREFERRED EMBODIMENT

Figures 1, 2, 3, 4, 5:
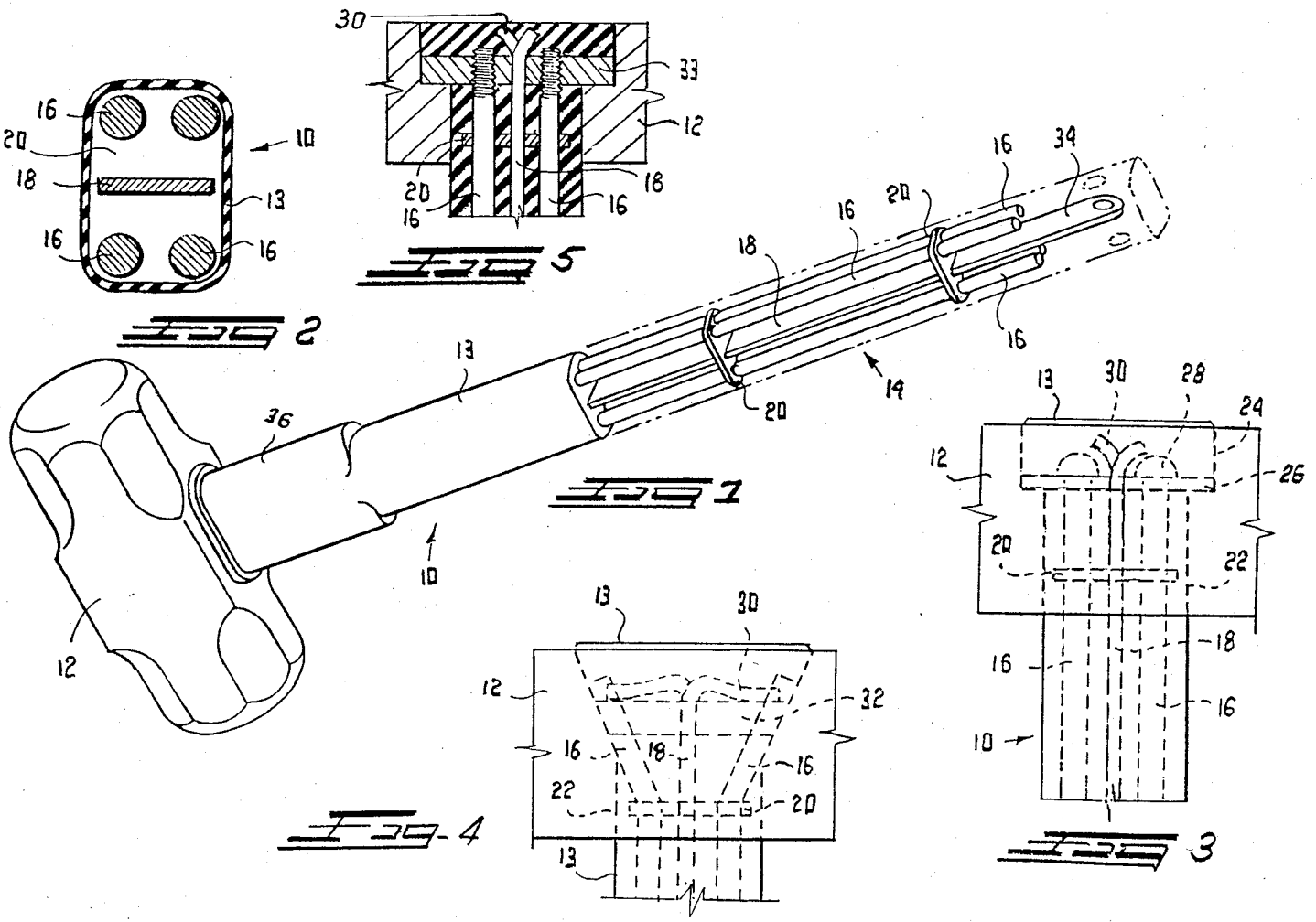
FIG. 1 is a partially sectioned perspective view of the hammer of the invention.
FIG. 2 is a sectioned end elevation of the handle of the FIG. 1 hammer.
FIG. 3 is a fragmentary side elevation of one arrangement for connecting the hammer handle to a hammer head.
FIG. 4 is a similar view to that of FIG. 3 illustrating a second handle attaching arrangement.
FIG. 5 is a sectioned side elevation of yet a further similar view to that of FIG. 3.

The hammer of the invention is shown in FIG. 1 of the drawings to consist of a handle 10 and a hammer head 12.

The handle 10 is made from a suitable elastomeric material 13 such as synthetic or vulcanised rubber and carries reinforcing which is indicated generally at 14.

The arrangement of the reinforcing, in this embodiment, is more clearly shown in FIG. 2 to consist of four rods 16 which are made from high tensile steel and a single strip of stainless steel 18. The rods 16 and strip 18 are held in the spaced relationship shown in FIG. 2 by spacers 20 which are engaged with the reinforcing elements at intervals over the length of the reinforcing.

Although the rods 16 are shown in this embodiment of the invention to be circular in cross-section, they could and preferably do have a flat sided cross-sectional shape such as square, hexagonal, triangular and the like which will offer greater resistance to twisting relatively to the handle elastomeric material to which they are bonded than rods of a circular cross-section. The rods may also have a twisted or other ridged or profiled shape and may vary in cross-section along their length to improve the bonding and reinforcing characteristics of the composite handle and head.

It is essential that the general direction of the plane of the strip 18 is, as is illustrated in the drawings, normal to the strike direction of the hammer head 12. The purpose of arranging the strip so is that at least one element of the reinforcing will offer maximum resistance to tortional movement of the head 12 on the handle as well as allowing the strip to flex in its natural plane. If the strip is located at right angles to the direction shown in the drawings, the possibility of the strip breaking adjacent the head due to metal fatigue is substantially increased relative to the life of the strip located as shown in the drawings.

The hammer head 12 carries, as seen in FIG. 3, a handle bore 22 which leads to an enlarged recess 24.

The handle reinforcing 14 terminates at an anchor plate 26 which has approximately the same area dimension as the base of the recess 24. The ends of the reinforcing rods 16 are upset onto the plate 26 to provide heads 28 which prevent the rods from pulling through the plate in use. The end of the strip 18 similarly passes through a slot in the plate with the protruding portion of the strip being split in the longitudinal direction of the strip to provide two or more ears 30 which are folded over out of the general plane of the strip on the back of the plate 26.

The handle material 13 is preferably moulded over and vulcanised onto the reinforcing 14 with the reinforcing and anchor plate located in the head 12 so that the elastomeric material is additionally vulcanised onto the head and the side walls of the bore 22 and recess 24.

A second embodiment of the handle locating arrangement is illustrated in FIG. 4. Here the recess 24 is tapered towards the bore and the reinforcing rods 16 are splayed outwardly to lie on the sides of the recess. A wedge shaped anchor plate 32, which carries suitably shaped recesses for the rods and a slot for the strip 18, is wedged over the splayed rods 16 in the recess with the split ends 30 of the strip 18 again being folded over onto the plate 32 to hold the plate in firm engagement with the rods 16.

Yet a further embodiment of the handle locating arrangement is illustrated in FIG. 5. In this embodiment the ends of the rods 16 are screw-threaded and engaged in threaded holes in an anchor plate 33. As with the previous embodiments, the strip 18 is passed through a slot in the plate 33 with its ears 30 being splayed above the plate.

The anchor plates 26, 32 and 33 are preferably apertured to enable the handle material 13 to pass through them during moulding.

Features of the hammer of the invention which have not been described above are the holed extention 34 of the strip 18 to provide a holding or hanging strap anchor which is integral with the reinforcing and a thickening of the handle material at 36 additionally to reinforce the handle in the portion of its length which is subject to the greatest bending moments in use.

The invention is not limited to the precise details as herein described and any suitable arrangement of the reinforcing could be employed to anchor the handle 10 to the head 12 and is not limited to only those arrangements illustrated in FIGS. 3 and 4.

I claim:

1. A hammer comprising a hammer head a handle connected to said hammer head, said handle being made from an elastomer, a plurality of rod-shaped sprung steel reinforcing elements, and a steel strip-shaped reinforcing element, carried within said handle's elastomer, said elements extending over the effective length of said handle with said rod-shaped reinforcing elements located adjacent each of the flat sides of said strip-shaped element but spaced from it, and the general plane of said strip-shaped element being normal to the strike direction of said hammer head, a plurality of spacers spaced over the length of the handle to maintain said elements in spaced relationship, a bore within said hammer head within which said handle is located in said head, a recess which surrounds the end of said bore on the opposite side of the head to that from which said handle projects, said reinforcing elements extending into said recess, and a locking plate which is engaged with said reinforcing elements in said recess to prevent withdrawal of said handle from said recess.

* * * * *